US012560344B2

(12) United States Patent
Rosso et al.

(10) Patent No.: US 12,560,344 B2
(45) Date of Patent: Feb. 24, 2026

(54) AIR CONDITIONING UNIT

(71) Applicant: MITSUBISHI ELECTRIC HYDRONICS & IT COOLING SYSTEMS S.P.A., Bassano del Grappa (IT)

(72) Inventors: Luigi Rosso, Bassano del Grappa (IT); Guido Dacco', Bassano del Grappa (IT)

(73) Assignee: MITSUBISHI ELECTRIC HYDRONICS & IT COOLING SYSTEMS S.P.A., Bassano del Grappa (IT)

( * ) Notice: Subject to any disclaimer, the term of this patent is extended or adjusted under 35 U.S.C. 154(b) by 562 days.

(21) Appl. No.: 17/876,216

(22) Filed: Jul. 28, 2022

(65) Prior Publication Data

US 2024/0035683 A1 Feb. 1, 2024

(51) Int. Cl.

| | |
|---|---|
| ***F24F 7/04*** | (2006.01) |
| ***F24F 1/0014*** | (2019.01) |
| ***F24F 1/0063*** | (2019.01) |

(52) U.S. Cl.

CPC ..... *F24F 7/04* (2013.01); *F24F 1/0014* (2013.01); *F24F 1/0063* (2019.02)

(58) Field of Classification Search

CPC ..... F24F 7/04; F24F 1/0014; F24F 1/0063; F24F 1/00073; F24F 2011/0006

See application file for complete search history.

(56) References Cited

U.S. PATENT DOCUMENTS 5,816,066 A * 10/1998 Aoki et al. ..... F24F 1/00 62/325
6,038,879 A * 3/2000 Turcotte et al. ..... F24F 1/022 62/325

(Continued)

FOREIGN PATENT DOCUMENTS

EP 1217879 A2 6/2002
WO WO2010009626 A1 1/2010

OTHER PUBLICATIONS

International Search Report and Written Opinion issued in connection with International Patent Application No. PCT/IB2023/057620 dated Oct. 31, 2023, 13 pages.

(Continued)

*Primary Examiner* — Jerry-Daryl Fletcher
*Assistant Examiner* — Dario Antonio Deleon
(74) *Attorney, Agent, or Firm* — KLINTWORTH & ROZENBLAT LLP

(57) ABSTRACT

Air conditioning unit for a structure defining a space to be conditioned, the air conditioning unit comprising a structure comprising a lateral wall and a pair of terminal walls connected together to defining a space and a first and a second openings realized in a wall opposite to lateral wall and configured to be faced to respective openings realized in structure, the air conditioning unit housing an air conditioning arrangement housed within space and comprising a cooling coil, first ventilation means and second ventilation means, the air conditioning unit comprises at least a divider wall configured to divide the space into at least two portions and is configured to comprise a free cooling arrangement provided with a first and a second dampers suitable to be housed within one between first and (Continued)

second openings of structure and a third damper suitable to be housed through lateral wall.

9 Claims, 5 Drawing Sheets

(56) References Cited

U.S. PATENT DOCUMENTS

| | | | | |
|---|---|---|---|---|
| 2016/0178223 | A1* | 6/2016 | James et al. | F24F 11/77 165/250 |
| 2021/0381709 | A1* | 12/2021 | Liu | F24F 11/64 |
| 2022/0018571 | A1* | 1/2022 | Yamaguchi et al. | F24F 12/003 |
| 2022/0397289 | A1* | 12/2022 | Ehrman | F24F 1/0063 |

OTHER PUBLICATIONS

Italian Search Report and Written Opinion for application No. IT202200016014 dated Feb. 22, 2023, 9 pages.

* cited by examiner

AIR CONDITIONING UNIT

TECHNICAL FIELD

The present invention concerns an air conditioning unit, in particular a packaged air conditioning unit.

The present invention finds its preferred, although not exclusive, application in telecommunication and IT shelters conditioning. Reference will be made to this application by way of example below.

BACKGROUND OF THE INVENTION

Air conditioning unit, as known, perform a refrigeration cycle to cool or heat an airflow directed to an environment to be conditioned.

In case of spaces voted to house telecommunication and IT shelters, it is requested that the air conditioning units provide a cool air flow to maintain the aforementioned spaces at a predefined temperature to guarantee a good operation of the electronic elements of the telecommunication and IT shelters.

To this aim it is known to provide the aforementioned air conditioning units with a so-called "free cooling" functionality, i.e. to avoid to use energy to carry out actively the refrigeration cycle and use the external air to the space to be conditioned to cool down the space itself.

It is clear that the aforementioned functionality is possible only when the external air is cooler than the air in the space to be conditioned.

However, the addition of a free-cooling functionality to known air conditioning unit needs to modification to the layout of the air conditioning unit that usually lead to a substantial reconfiguration of its shape and encumbrance.

Therefore, it is clear that it is needed to provide a free cooling functionality in air conditioning unit that is economic and compact.

An aim of the present invention is to satisfy the above mentioned needs in a cost-effective and optimized manner.

SUMMARY OF THE INVENTION

The aforementioned aim is reached by an air conditioning unit as claimed in the appended set of claims.

BRIEF DESCRIPTION OF DRAWINGS

For a better understanding of the present invention, a preferred embodiment is described in the following, by way of a non-limiting example, with reference to the attached drawings wherein.

DETAILED DESCRIPTION OF THE INVENTION

Figure 2:
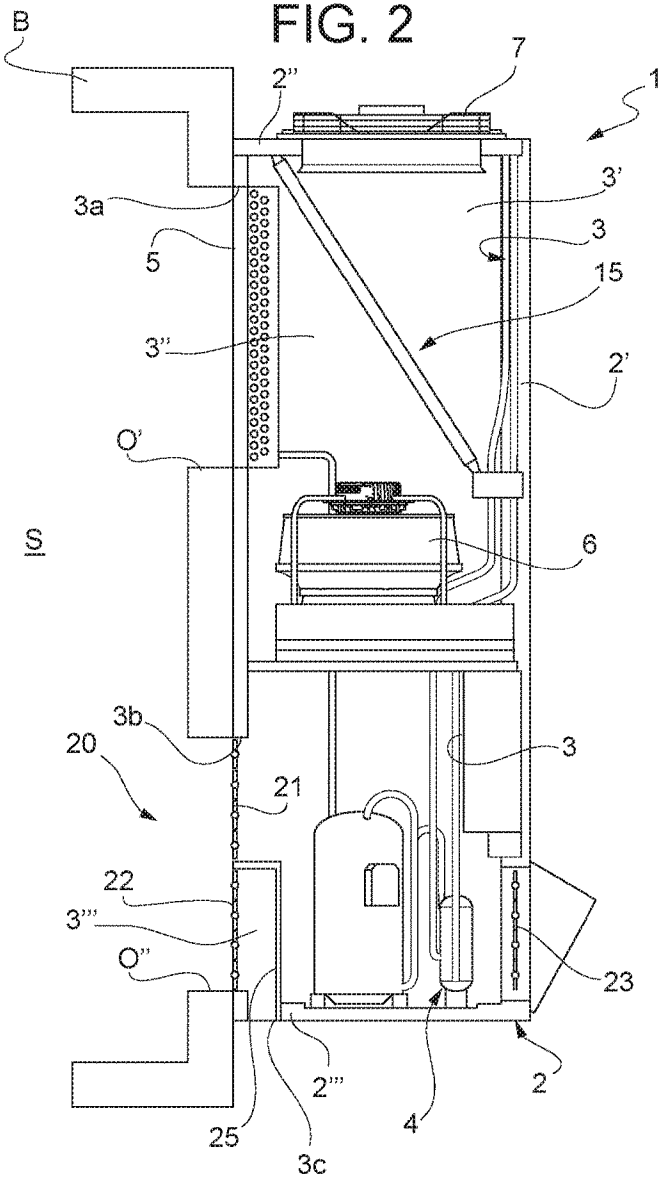
FIG. 2 is a schematic representation of a second embodiment of an air conditioning unit according to the invention.
Figure 1:
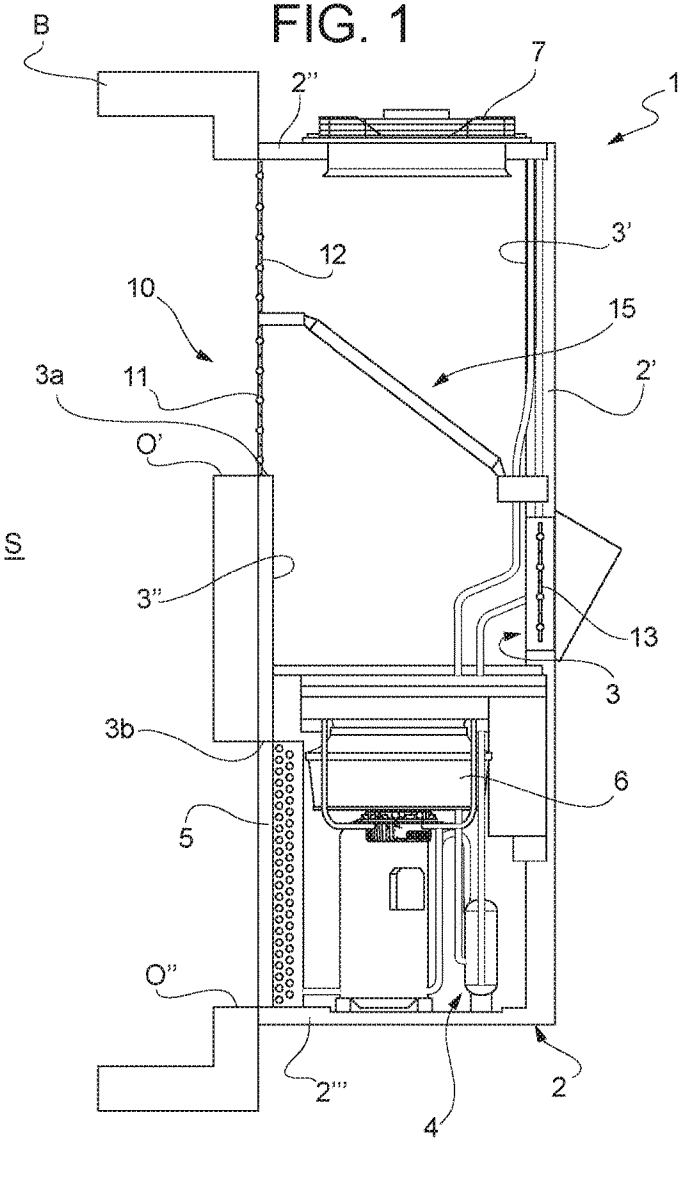
FIG. 1 is a schematic representation of a first embodiment of an air conditioning unit according to the invention.

FIGS. 1 and 2 discloses an air conditioning unit 1 for condition a space S delimited by a structure B provided with a first and a second opening O', O".

In both embodiment of FIGS. 1 and 2 the structure B may be a building provided with a pair of openings O', O" that are linearly, e.g. vertically, aligned one with respect to the other, i.e. the opening planes are substantial coincident.

The air conditioning unit 1 comprises a structure 2, preferably substantially rectangular in shape, and configured to limit a space 3 from the environment. The structure 2 further defines two openings 3*a*, 3*b* configured to allow the fluidic communication of space 3 with first and second openings O', O" of structure B. Accordingly, also openings 3*a*, 3*b* are aligned parallel to a longitudinal axis of the structure 2 and are preferably coplanar one with the other.

The structure 2 comprises a lateral wall 2' opposite to the openings 3*a*, 3*b* and a pair of terminal walls 2", 2" namely an upper wall 2" and a lower wall 2". The aforementioned walls are connected together to define the space 3 that is separated by the environment.

The air conditioning unit 1 comprises, housed within space 3, an air conditioning arrangement 4 configured to allow insertion through one of openings O', O" of a conditioned air flow.

In particular, the air conditioning arrangement 4 comprises, inter alia, a cooling coil 5 configured to allow the cooling of an airflow passing through this latter and a first and a second ventilation means 6, 7 configured to allow circulation of air flow within space 3 as outlined in detail below. Other details of the air conditioning arrangement 4 will not be provided since they are not pertinent to the present invention.

According to the invention, the air conditioning unit 1 is configured to be provided with a free cooling arrangement 10, 20 configured to allow a free cooling functionality.

In particular, the free cooling arrangement 10, 20 comprises a first and a second dampers 11, 21, 12, 22 suitable to be housed within one of openings 3*a*, 3*b* of the structure 2 and a third damper 13, 23 suitable to be housed in lateral wall 2'. The aforementioned dampers are configured, if present, to control, e.g. allow or deny or partially allow, the fluidic communication, respectively, with the space 3 towards the environment of space S or to environment outside structure 2 to space 3.

As known, such dampers may be realized in any suitable shape and are preferably controlled by actuator means (not shown) that can be electronically controlled via an electronic control unit (not shown).

Such electronic control unit may automatically control or be activated by the user to provide different cooling operations as detailed below.

Furthermore, the structure 2 comprises at least a divider wall 15 configured to divide space 3 into at least two portions 3', 3" wherein a first portion 3' houses the second ventilation means 7 and the second portion 3" houses the first ventilation means 6 and the cooling coil 5.

The first portion 3' is selectively or continuously in fluid communication with the environment in order to cool down a heat exchanger making part of the air conditioning arrangement 4 and that need to be cooled to allow operation of cooling coil 5. Further details will no be provided on such aspect for brevity.

Making reference to a first embodiment of the invention, shown in FIG. 1, the air conditioning unit 1 is configured to provide a cooling flow in the second opening O", i.e. through the second, lower, opening 3*b*.

Accordingly, the cooling coil 5 is placed to occupy the entire lower opening 3*b* of structure 2 so as to direct the cooled air flow towards the opening O". The first ventilation means 6 is configured to move air towards the lower opening 3*b* and the second ventilation means 7 are configured to move air from the first opening 3*a* towards environment In particular, the divider wall 15 is placed so as to divide into two portions the first opening 3*a* each of such two portions houses respectively a first and a second damper 11, 12. Therefore the first damper 11 is configured to allow selective fluidic communication of the space S with the first portion 3' of space 3 and the second damper 12 is configured to allow selective fluidic communication of the space S with the second portion 3" of space 3. The third damper 13 is housed within the lateral wall 2' and configured to selectively allow the communication of environment with space 3" in a position upstream to first ventilation means 6 with respect to the air flow passing through this latter.

Making reference to a second embodiment of the invention, shown in FIG. 2, the air conditioning unit 1 is configured to provide a cooling flow in the first opening O', i.e. through the first, upper, opening 3*a*.

Accordingly, the cooling coil 5 is placed to occupy the entire first opening 3*a* of structure 2 so as to direct the cooled air flow towards the opening O'. The first ventilation means 6 is configured to move air towards the upper opening 3*a* and the second ventilation means 7 are configured to move air from space 3 towards environment In particular, the divider wall 15 is placed so as to not interfere with cooling coil i.e. so that the cooling coil 5 is entirely in second portion 3" as mentioned above.

The arrangement according to the second embodiment further comprises a second divider wall 25 configured to divide into two portions the first opening 3*b* each of such two portions houses respectively a first and a second damper 11, 12.

In particular, such second divider wall 25 divides the second portion 3" from a further third portion 3—that is in fluid communication with the environment via a third opening 3*c* realized in the lower terminal portion 2'''.

Preferably, as shown, the second divider wall 25 is L-shaped so as not interfere with air conditioning arrangement 4.

In particular, the first damper 21 is configured to allow selective fluidic communication of the space S with the second portion 3" of space 3 and the second damper 22 is configured to allow selective fluidic communication of the space S with the third portion 3''' of space 3, i.e. to environment. The third damper 23 is housed within the lateral wall 2' and configured to selectively allow the communication of environment with space 3" in a position upstream to first ventilation means 6 with respect to the air flow passing through this latter.

The operation of the first embodiment of the invention as described above is the following.

Figure 3B:
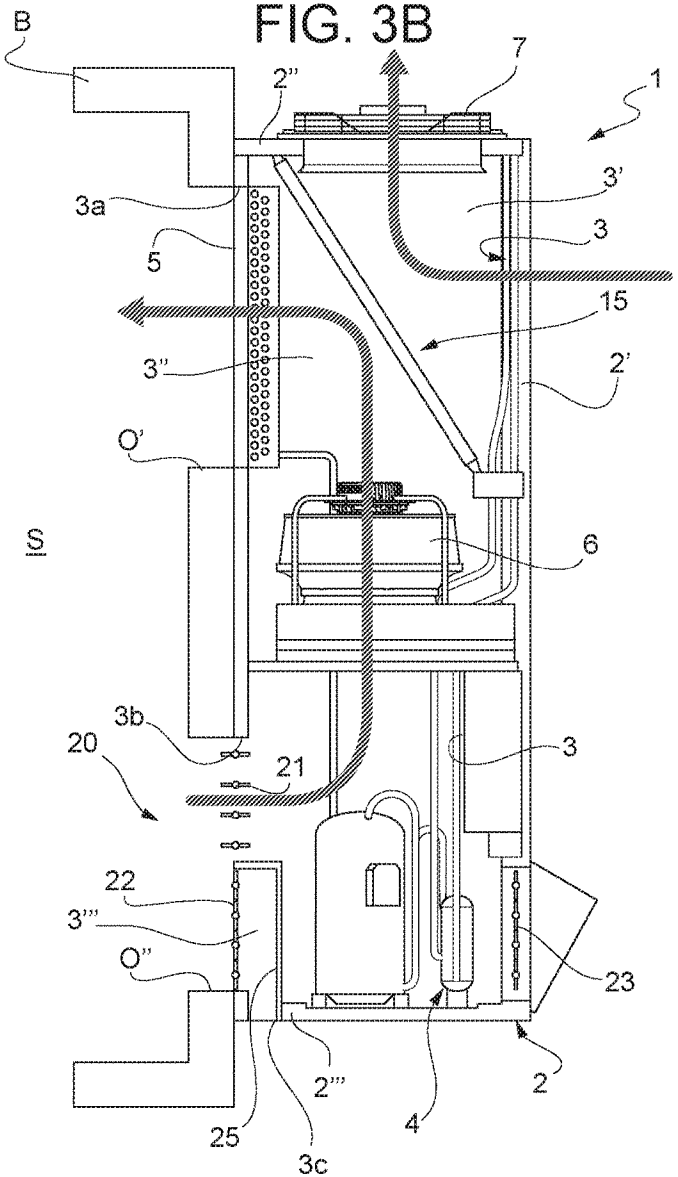
FIGS. 3A-3B are schematic representation of the air conditioning unit of FIGS. 1 and 2 in a first operative condition.
Figure 3A:
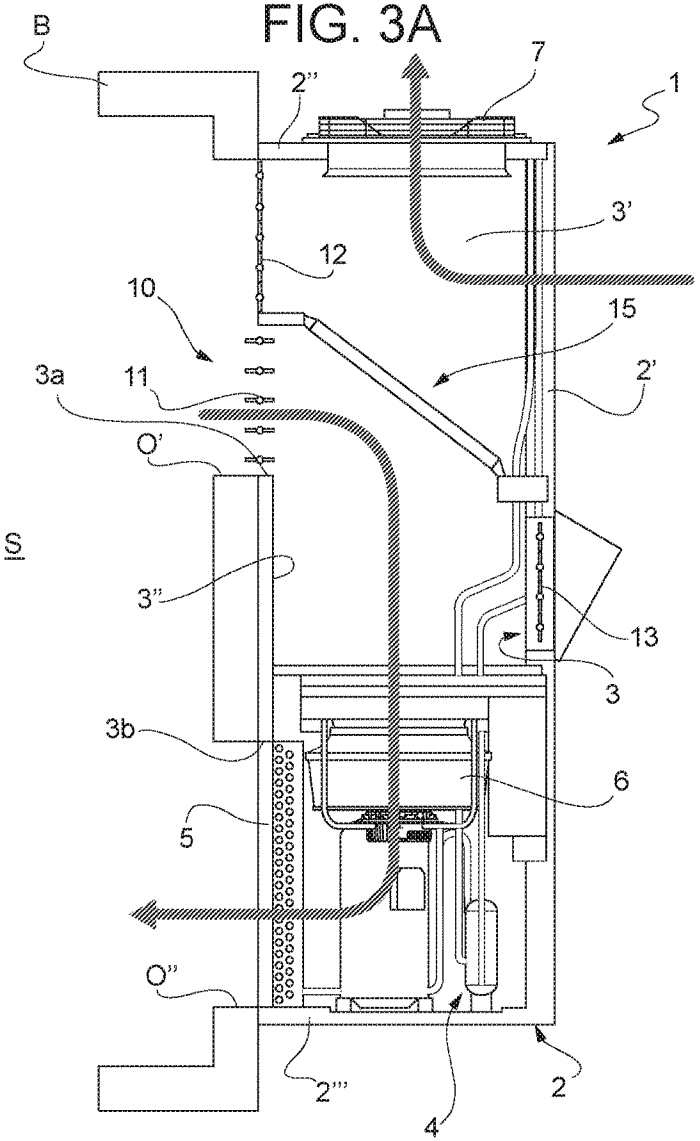

In a first operative condition, schematized in FIG. 3A, a so-called "mechanical cooling" the second damper 12 is opened while the first and third dampers 11, 13 are closed. The first ventilation means 6 are controlled to suck an air flow from space S and provide such air flow, cooled via cooling coil 5 operated via air cooling arrangement 4, back within space S. The second ventilation means 7 are controlled to suck air from environment to cool down the other operative elements of the air cooling arrangement 4. Such operative condition is indicated if the temperature in environment is greater than the temperature required in space S.

Figure 4B:
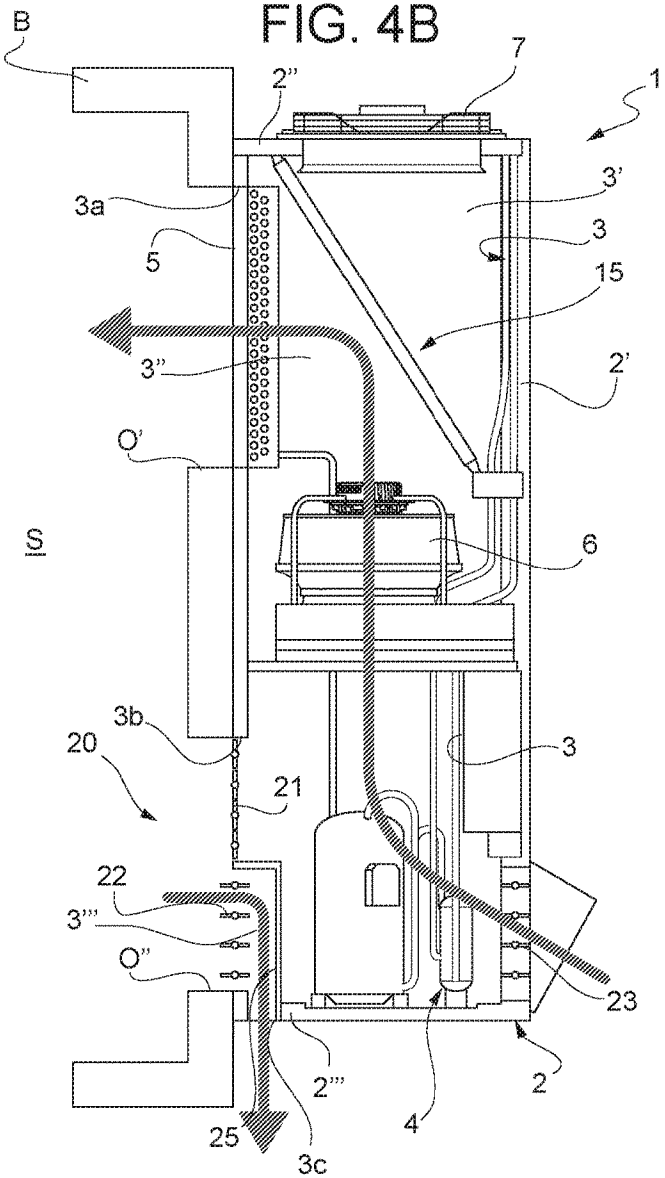
FIGS. 4A-4B are schematic representation of the air conditioning unit of FIGS. 1 and 2 in a first operative condition.
Figure 4A:
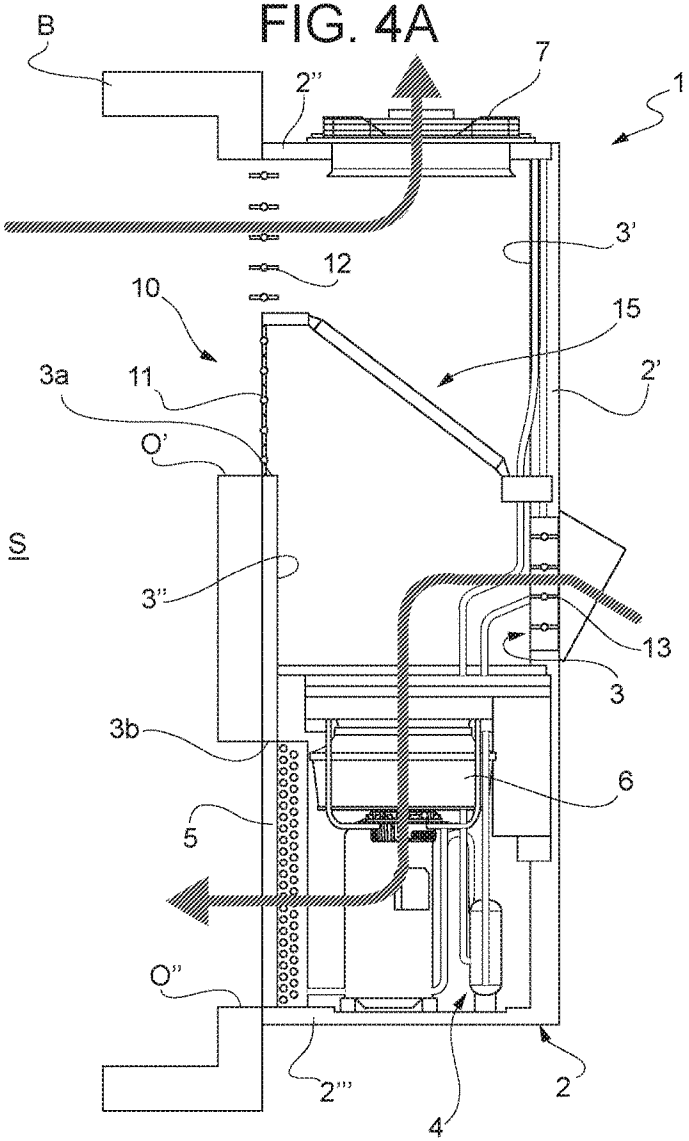

In a second operative condition, schematized in FIG. 4A, a so-called "free cooling" the second damper 12 is closed while the first and third dampers 11, 13 are opened. The first ventilation means 6 are controlled to suck an air flow from environment via third damper 13 and provide such air flow, within space S. The overpressure air flow is sucked by second ventilation means 7 that flow out the latter into environment. Such operative condition is indicated if the temperature in environment is lower than the temperature required in space S.

Figure 5B:
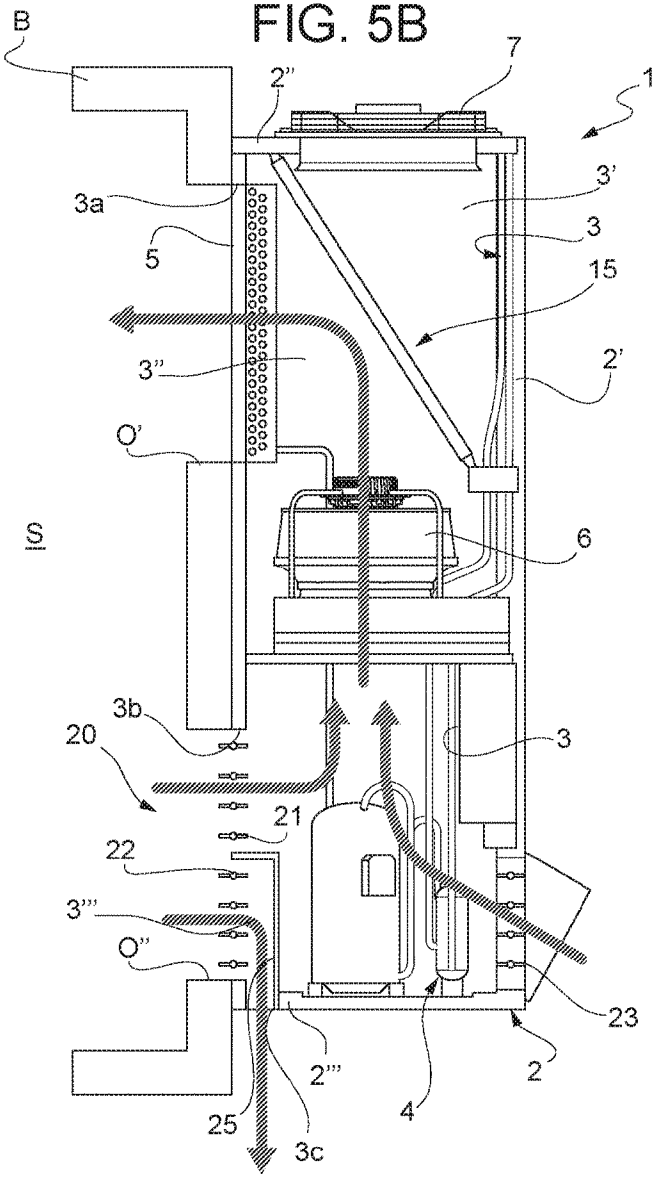
FIGS. 5A-5B are schematic representation of the air conditioning unit of FIGS. 1 and 2 in a first operative condition.
Figure 5A:
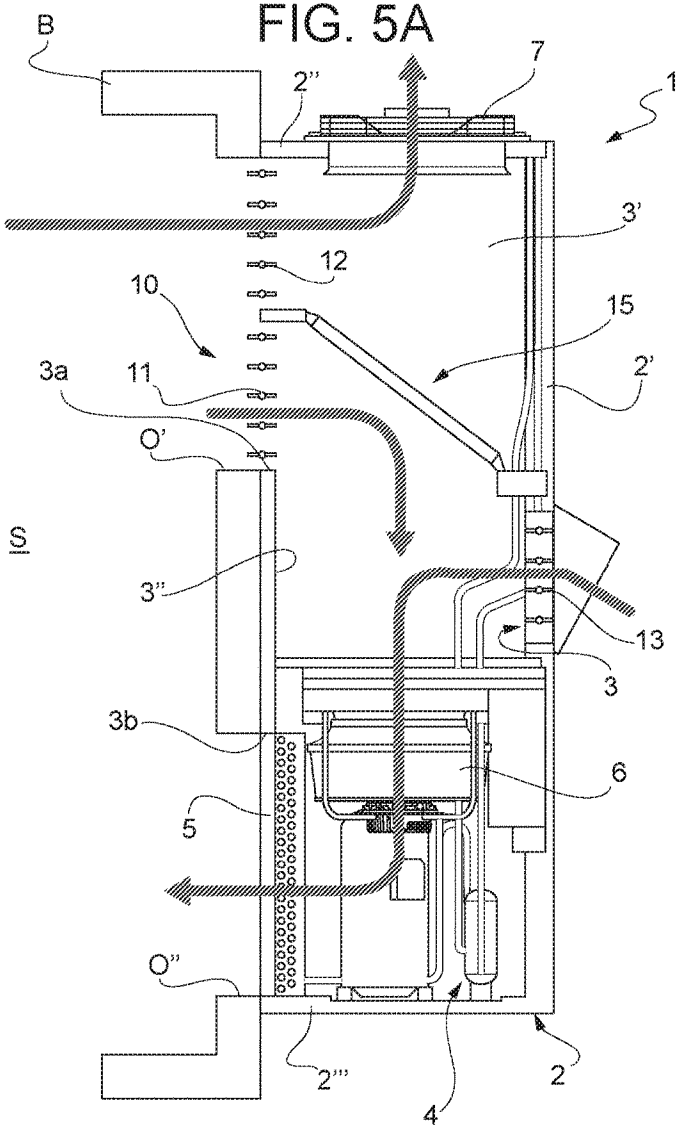

In a third operative condition, schematized in FIG. 5A, a so-called "partial free cooling" the all the dampers 11, 12 and 13 are opened. The first ventilation means 6 are controlled to suck an air flow from environment via third damper 13 and provide such air flow, within space S. The overpressure airflow is partially sucked by second ventilation means 7 that flow out the latter into environment and partially sucked by first ventilation means 6 that flow back this latter to the air flow sucked from the third damper 13. Such operative condition is indicated if the temperature in environment is lower than the temperature required in space S over a predetermined threshold.

Figure 6B:
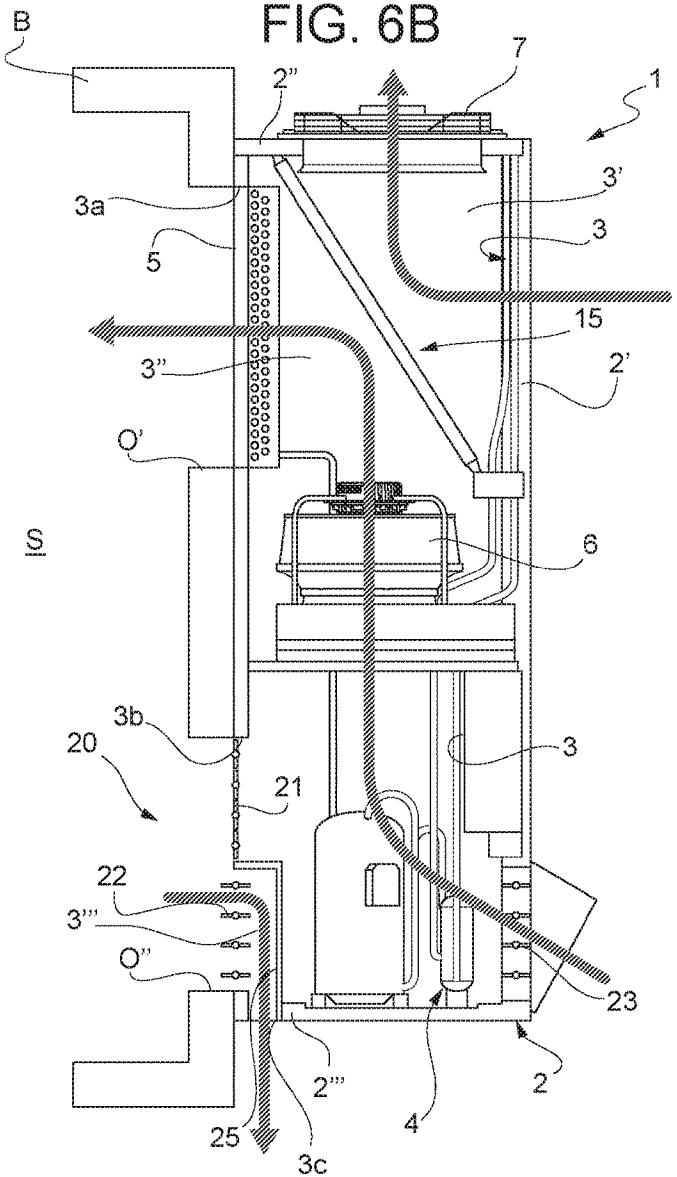
FIGS. 6A-6B are schematic representation of the air conditioning unit of FIGS. 1 and 2 in a first operative condition.
Figure 6A:
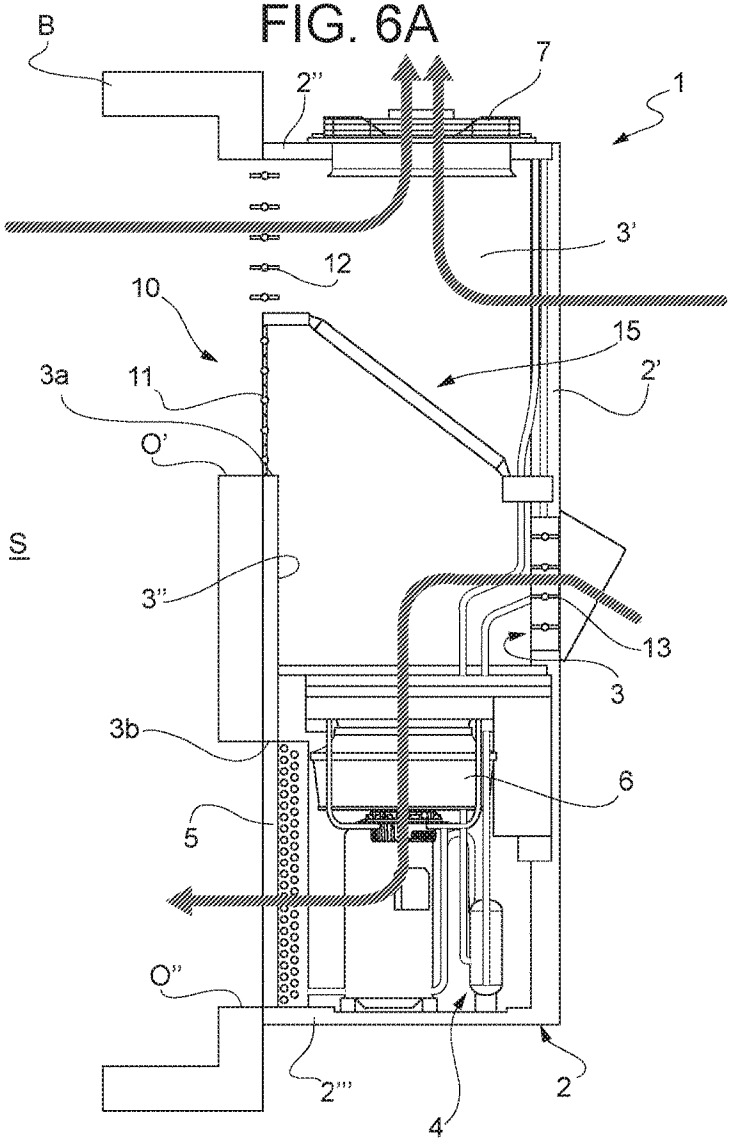

In a fourth operative condition, schematized in FIG. 6A, a so-called "mechanical and free cooling" the second damper and third dampers 12, 13 are opened while the first dampers 11 is closed. The first ventilation means 6 are controlled to suck an air flow from the environment and provide such air flow, cooled via cooling coil 5 operated via air cooling arrangement 4, back within space S. The second ventilation means 7 are controlled to suck air from environment to cool down the other operative elements of the air cooling arrangement 4. Such operative condition is indicated if the external temperature is not low enough to cool the room S to the required temperature. The advantage is that the energy absorbed by the mechanical cooling is lower than with complete cooling.

The operation of the second embodiment of the invention as described above is the following.

In a first operative condition, schematized in FIG. 3B, a so-called "mechanical cooling" first damper 21 is opened while the second and third dampers 22, 23 are closed. The first ventilation means 6 are controlled to suck an air flow from space S and provide such air flow, cooled via cooling coil 5 operated via air cooling arrangement 4, back within space S. The second ventilation means 7 are controlled to suck air from environment to cool down the other operative elements of the air cooling arrangement 4. Such operative condition is indicated if the temperature in environment is greater than the temperature required in space S.

In a second operative condition, schematized in FIG. 4*b*, a so-called "free cooling" the first damper 21 is closed while the second and third dampers 22, 23 are opened. The first ventilation means 6 are controlled to suck an air flow from environment via third damper 13 and provide such air flow, within space S. The overpressure air flow naturally flows out via third opening 3*c* into environment. Such operative condition is indicated if the temperature in environment is lower than the temperature required in space S.

In a third operative condition, schematized in FIG. 5B, a so-called "partial free cooling" the all the dampers 21, 22 and 23 are opened. The first ventilation means 6 are controlled to suck an air flow from environment via third damper 23 and provide such air flow, within space S. The overpressure airflow is partially sucked by first ventilation means 6 that flow back this latter to the air flow sucked from the third damper 23. The overpressure air flow naturally flows out via third opening 3*c* into environment. Such operative condition is indicated if the temperature in environment is lower than the temperature required in space S over a predetermined threshold.

In a fourth operative condition, schematized in FIG. 6B, a so-called "mechanical and free cooling" the first dampers 21 is closed and the second damper and third dampers 22, 23 are opened. The first ventilation means 6 are controlled to suck an air flow from the environment and provide such air flow, cooled via cooling coil 5 operated via air cooling arrangement 4, back within space S. The second ventilation means 7 are controlled to suck air from environment to cool down the other operative elements of the air cooling arrangement 4. The overpressure air flow naturally flows out via third opening 3*c* into environment Such operative condition is indicated if the external temperature is not low enough to cool the room S to the required temperature. The advantage is that the energy absorbed by the mechanical cooling is lower than with complete cooling.

In view of the foregoing, the advantages of an air conditioning unit 1 according to the invention are apparent.

The use of a common structure for both upper and lower blow of cooled airflow and for "free-cooling" and "standard" arrangement allow a great economy in fabrication of the air conditioning unit.

Indeed, there is only need to arrange the operative element of the air conditioning arrangement within the air conditioning unit and to provide, if needed, the dampers and the divider walls to provide high number of different configuration with the same common structure.

Accordingly, the proposed common structure allow economy of scale, less time for manufacturing and is versatile.

It is clear that modifications can be made to the described air conditioning unit 1 which do not extend beyond the scope of protection defined by the claims.

For example, the shapes of the unit 2 and the internal arrangement of air refrigeration apparatus may vary according to their dimension and the needs of the unit 2.

Similarly, the dampers are schematized but they can be realized as preferred, as on-off dampers or proportional dampers.

The invention claimed is:

1. An air conditioning unit for a first structure defining a first space to be conditioned, said air conditioning unit comprising a second structure comprising a lateral wall and a pair of terminal walls connected together to define a second space, a first opening and a second opening realized in a wall opposite to said lateral wall and configured to be faced to respective third and fourth openings realized in said first structure, said air conditioning unit housing an air conditioning arrangement within said second space and comprising a cooling coil, a first ventilation means and a second ventilation means, said cooling coil being housed in one of said first and second openings and operable to cool down a first air flow passing through itself and directed towards said first space, said first ventilation means being housed within said second space to allow circulation of the first air flow through said cooling coil and said second ventilation means being carried by one of said terminal walls to allow circulation of a second air flow towards an environment outside first and second structures, wherein said air conditioning unit comprises a fixed divider wall that divides said second space into at least two portions and wherein the fixed divider wall is disposed at a location to fluidically isolate the at least two portions from one another wherein a first portion houses said second ventilation means and wherein a second portion houses said first ventilation means and said cooling coil, wherein said air conditioning unit comprises a free cooling arrangement provided with a first damper and a second damper housed within one of said first and second openings and a third damper housed through said lateral wall, said first and second dampers being operable to control the passage of an air flow through themselves between said one of-said first and second openings and said second space and said third damper being operable to control the passage of an air flow through itself between said second space and said environment.

2. The air conditioning unit according to claim 1, wherein said cooling coil is housed in said second opening and said first opening houses said first and second dampers, said fixed divider wall dividing said first opening into first and second opening portions, the first opening portion housing said first damper allowing fluidic communication between said first space and said first portion and the second opening portion housing said second damper allowing fluidic communication between said first space and said second portion.

3. The air conditioning unit according to claim 2, wherein said third damper is placed upstream with respect to the first air flow managed by said first ventilation means.

4. Air conditioning unit according to claim 1, wherein said cooling coil is housed by said first opening and said second opening is configured to house said first and second dampers, the air conditioning unit comprising a second divider wall being configured to divide said second opening into two portions, one configured to house said first damper configured to allow fluidic communication between said space and said second portion and a second portion configured to house said second damper configured to allow fluidic communication between said space and a third portion in direct fluid communication with the environment.

5. Air conditioning unit according to claim 4, wherein said second divider wall is L-shaped.

6. The air conditioning unit according to claim 1, wherein said first and second openings are aligned parallel to a longitudinal axis of said structure.

7. The air conditioning unit according to claim 1, wherein said first and second openings are coplanar.

8. The air conditioning unit according to claim 1, wherein said unit is operable in multiple operative functionalities comprising at least:

a mechanical cooling functionality wherein said first damper is open and the second and third dampers are closed and the air conditioning arrangement is operated to provide a cooled air flow through said cooling coil;

a free cooling functionality wherein said first second and third dampers are opened and said first damper is closed and the first and second ventilation means are operated to allow air flow circulation;

a partial free cooling functionality wherein all said dampers are opened and the first and second ventilation means are operated to allow air flow circulation; and a mechanical plus free cooling functionality wherein said second and third dampers are opened and said first damper is closed and the air conditioning arrangement is operated to provide a cooled air flow through said cooling coil.

9. The air conditioning unit according to claim 1, wherein said operative functionality comprises at least:

a mechanical cooling functionality wherein said second and third dampers are closed and the first dampers is opened and the air conditioning arrangement is operated to provide a cooled air flow through said cooling coil;

a free cooling functionality wherein said second and third dampers are opened and said first damper is closed and the first and second ventilation means are operated to allow air flow circulation;

a partial free cooling functionality wherein all said dampers are opened and the first and second ventilation means are operated to allow air flow circulation;

a mechanical plus free cooling functionality wherein said second and third dampers are closed and the first dampers is opened and the air conditioning arrangement is operated to provide a cooled air flow through said cooling coil.

* * * * *